US008887616B2

(12) United States Patent
Kenney

(10) Patent No.: US 8,887,616 B2
(45) Date of Patent: Nov. 18, 2014

(54) AUTO REGULATING GAS SYSTEM FOR SUPRESSED WEAPONS

(71) Applicant: RA Brands, L.L.C., Madison, NC (US)

(72) Inventor: Daniel E. Kenney, Cecilia, KY (US)

(73) Assignee: RA Brands, L.L.C., Madison, NC (US)

( * ) Notice: Subject to any disclaimer, the term of this patent is extended or adjusted under 35 U.S.C. 154(b) by 21 days.

(21) Appl. No.: 13/800,081

(22) Filed: Mar. 13, 2013

(65) Prior Publication Data

US 2014/0196599 A1 Jul. 17, 2014

Related U.S. Application Data

(60) Provisional application No. 61/751,625, filed on Jan. 11, 2013.

(51) Int. Cl.

| | |
|---|---|
| ***F41A 5/28*** | (2006.01) |
| ***F41C 27/06*** | (2006.01) |
| ***F41A 21/30*** | (2006.01) |
| ***F41A 33/00*** | (2006.01) |

(52) U.S. Cl.

CPC . *F41A 5/28* (2013.01); *F41C 27/06* (2013.01); *F41A 21/30* (2013.01); *F41A 33/00* (2013.01)

USPC ..... 89/193

(58) Field of Classification Search

CPC ..... F41A 5/18; F41A 5/24; F41A 5/26; F41A 5/28; F41C 27/06

USPC ..... 89/191.01, 193

See application file for complete search history.

(56) References Cited

U.S. PATENT DOCUMENTS 2,416,287 A * 2/1947 Coates et al. ..... 42/105
2,800,059 A 7/1957 Miller (Continued)

FOREIGN PATENT DOCUMENTS

EP 0158707 A2 10/1985
WO WO 2010-111109 A1 9/2010
WO WO 2010-123604 A2 10/2010

OTHER PUBLICATIONS

International Search Report dated Apr. 11, 2014 for International Application No. PCT/US2014/010090 filed Jan. 2, 2014.

(Continued)

*Primary Examiner* — Stephen M Johnson

(74) *Attorney, Agent, or Firm* — Womble Carlyle Sandridge & Rice, LLP

(57) ABSTRACT

An auto regulating gas system to automatically regulate the operating speed of an auto loading weapon having a gas operating system by restricting the gas flow from the firing of a projectile. A gas block attached to the barrel or the weapon redirects a volume of propellant gases to cycle the weapon, the gas block including a gas port for directing propellant gases received from the a gas port of the barrel into the gas system. A spring-loaded plunger assembly is positioned within the gas block, the plunger assembly including a regulator plunger having a reduced flow orifice, a regulator bushing, a regulator spring, and a regulator cap, wherein the position of the regulator plunger within the gas block automatically controls an amount of gas that is allowed to enter the gas system. A mechanical backup linkage assembly is attached to the gas block as a backup device for returning the regulator plunger to a forward position in the gas block when a muzzle device mounted on a muzzle of the firearm is removed.

29 Claims, 9 Drawing Sheets

(56) References Cited

U.S. PATENT DOCUMENTS

| | | | | |
|---|---|---|---|---|
| 3,020,807 | A | | 2/1962 | Hailston et al. |
| 3,058,400 | A | * | 10/1962 | Hailston et al. ..... 89/193 |
| 3,568,564 | A | | 3/1971 | Badali |
| 3,968,727 | A | | 7/1976 | Hyytinen |
| 3,990,348 | A | | 11/1976 | Vesamaa |
| 4,085,654 | A | | 4/1978 | Panigoni |
| 4,102,243 | A | | 7/1978 | Jennie |
| 4,125,054 | A | | 11/1978 | Jennie |
| 4,174,654 | A | | 11/1979 | Liedke |
| 4,373,423 | A | | 2/1983 | Moore |
| 4,389,920 | A | | 6/1983 | Dufour, Sr. |
| 4,414,880 | A | | 11/1983 | Throner |
| 4,702,146 | A | | 10/1987 | Ikeda et al. |
| 4,872,392 | A | | 10/1989 | Powers et al. |
| 4,901,623 | A | | 2/1990 | Lee |
| 5,218,163 | A | | 6/1993 | Dabrowski |
| 5,272,956 | A | | 12/1993 | Hudson |
| 5,388,500 | A | | 2/1995 | Petrovich |
| 5,959,234 | A | | 9/1999 | Scaramucci et al. |
| 6,374,720 | B1 | | 4/2002 | Tedde |
| 6,508,160 | B2 | | 1/2003 | Beretta |
| 6,715,396 | B2 | | 4/2004 | Dionne |
| 6,971,202 | B2 | | 12/2005 | Bender |
| 6,973,863 | B1 | | 12/2005 | Jones |
| 7,258,056 | B2 | | 8/2007 | Guesnet et al. |
| 7,810,423 | B2 | | 10/2010 | Monroe |
| 7,856,917 | B2 | | 12/2010 | Noveske |
| 7,891,284 | B1 | | 2/2011 | Barrett |
| 7,926,404 | B2 | | 4/2011 | Brittingham |
| 7,942,090 | B1 | | 5/2011 | Hoffman |
| 7,946,214 | B2 | | 5/2011 | Stone |
| 8,042,448 | B1 | | 10/2011 | Sylvester et al. |
| 8,065,949 | B1 | | 11/2011 | Molinari |
| 8,161,864 | B1 | | 4/2012 | Vuksanovich |
| 8,201,489 | B2 | | 6/2012 | Juarez |
| 8,245,625 | B2 | | 8/2012 | Winge |
| 8,250,964 | B2 | | 8/2012 | Stone |
| 8,261,653 | B2 | | 9/2012 | Crommett |
| 8,316,756 | B1 | | 11/2012 | Woodell et al. |
| 2005/0115398 | A1 | | 6/2005 | Olson |
| 2006/0278205 | A1 | | 12/2006 | Axelsson |
| 2009/0229454 | A1 | | 9/2009 | Fluhr et al. |
| 2010/0071541 | A1 | | 3/2010 | Barrett |
| 2010/0275770 | A1 | | 11/2010 | Noveske |
| 2011/0107900 | A1 | | 5/2011 | Presz, Jr. et al. |
| 2012/0167749 | A1 | | 7/2012 | Young |
| 2012/0167756 | A1 | | 7/2012 | Larue |
| 2012/0167757 | A1 | | 7/2012 | Gomez |

OTHER PUBLICATIONS

Written Opinion dated Apr. 11, 2014 for International Application No. PCT/US2014/010090 filed Jan. 2, 2014.

Jacob Gottfredson, Standing ready: Sig Sauers 516 patrol rifle, Guns Magazine, Mar. 1, 2012, pp. 68-70, vol. 58, issue 3, Publishers Development Corporation.

Michael O. Humphries, SIG Sauer SIG556 Classic, Aug. 23, 2012, 2 pages, National Rifle Association, http://www.americanrifleman.org/ArticlePage.aspx?id=1661&cid=4.

* cited by examiner

AUTO REGULATING GAS SYSTEM FOR SUPRESSED WEAPONS

CROSS-REFERENCE TO RELATED APPLICATION

This application claims the benefit of U.S. Provisional Patent Application Ser. No. 61/751,625, filed on Jan. 11, 2013. The specification and drawings of the provisional patent application are specifically incorporated by reference herein. This application is related to co-pending and commonly assigned U.S. application Ser. No. 13/799,734, filed on Mar. 13, 2013.

TECHNICAL FIELD

The present invention generally relates to gas operating systems for firearms and, more particularly, to automatic gas regulation systems for firearms.

BACKGROUND OF THE INVENTION

Semi-automatic firearms, such as rifles and shotguns, are designed to fire a round of ammunition, such as a cartridge or shotshell, in response to each squeeze of the trigger of the firearm, and thereafter automatically load the next shell or cartridge from the firearm magazine into the chamber of the firearm. During firing, the primer of the round of ammunition ignites the propellant (powder) inside the round, producing an expanding column of high pressure gases within the chamber and barrel of the firearm. The force of this expanding gas propels the bullet/shot of the cartridge or shell down the barrel.

In standard auto loading rifles, the addition of a silencer or suppressor to the muzzle of the weapon generates an increase in operating energy, causing the rifle to cycle faster than it would normally cycle if the suppressor were not installed. In known systems, the operator manually switches a gas regulating device to modify the operating characteristics of the weapon to compensate for this increased cyclic rate. This manual switch will typically have a lever or rotational plug that requires the operator to manually switch the system from one setting to the other. In a manually switched gas system, gases are either diverted (bled off) or restricted in order to reduce the overall energy available to operate the firearm.

SUMMARY

The disclosed embodiments are directed to a mechanism to automatically regulate the operating speed of a weapon having a gas operating system by restricting the gas flow from the firing of a projectile. The embodiments describe a system and methods in which the action of installing a suppressor on the weapon actuates a regulating mechanism to reduce the energy available to drive a gas operating system by restricting the gas flow from the barrel to the gas operating system and to substantially match operating speeds between suppressed and unsuppressed operation.

In an autoloading firearm, installing a sound suppressor (silencer) on the weapon typically can cause the cyclic operation of the weapon to speed up due to residual pressures in the suppressor and bore of the weapon. Commonly available systems require the manual activation of a regulator to reduce the initial energy available to the operating system to balance the extra energy imparted by the residual bore pressure.

In one embodiment having a gas regulation system, when a suppressor is not attached to the muzzle, a gas port in the barrel is free to provide energy to cycle the weapon. When a suppressor is attached to the muzzle, the suppressor depresses a regulator plunger which restricts gas flow from the gas port, reducing the amount of gas entering the system to cycle the weapon. The regulator plunger returns to a spring-biased forward position in the gas block when the suppressor is removed.

In another embodiment, an auto regulating gas system is provided for an auto loading firearm. The auto regulating gas system includes a gas block attached to a barrel of the firearm to redirect a volume of propellant gases, the gas block including a gas port for directing propellant gases received from a gas port of the barrel into a gas tube to cycle the auto loading firearm. A spring-loaded plunger assembly is positioned within the gas block, the plunger assembly including a regulator plunger having a reduced flow orifice, a regulator bushing, a regulator spring, and a regulator cap, wherein the position of the regulator plunger within the gas block automatically controls an amount of gas that is allowed to enter the gas system. Mounting a muzzle device, such as a suppressor over the muzzle drives the regulator plunger rearward moving the reduced flow orifice over the gas port in the gas block to automatically reduce the volume of propellant gases directed into the gas system.

In a further embodiment, an auto regulating gas system is provided for an auto loading firearm. The auto regulating system includes a gas block attached to the barrel to redirect a volume of propellant gases to cycle the auto loading weapon, the gas block including a gas port for directing propellant gases received from the a gas port of the barrel into the gas system. A spring-loaded plunger assembly is positioned within the gas block, the plunger assembly including a regulator plunger having a reduced flow orifice, a regulator bushing, a regulator spring, and a regulator cap, wherein the position of the regulator plunger within the gas block automatically controls an amount of gas that is allowed to enter the gas system. A mechanical backup linkage assembly is attached to the gas block for returning the regulator plunger to a forward position in the gas block when a muzzle device mounted on a muzzle of the firearm is removed.

These and other advantages and aspects of the embodiments of the disclosure will become apparent and more readily appreciated from the following detailed description of the embodiments taken in conjunction with the accompanying drawings, as follows. It further will be understood that the present drawings may not necessarily be drawn to scale and dimensions therein are for illustrative purposes and should not be taken as limiting the scope of the present invention.

DETAILED DESCRIPTION

Figure 1:
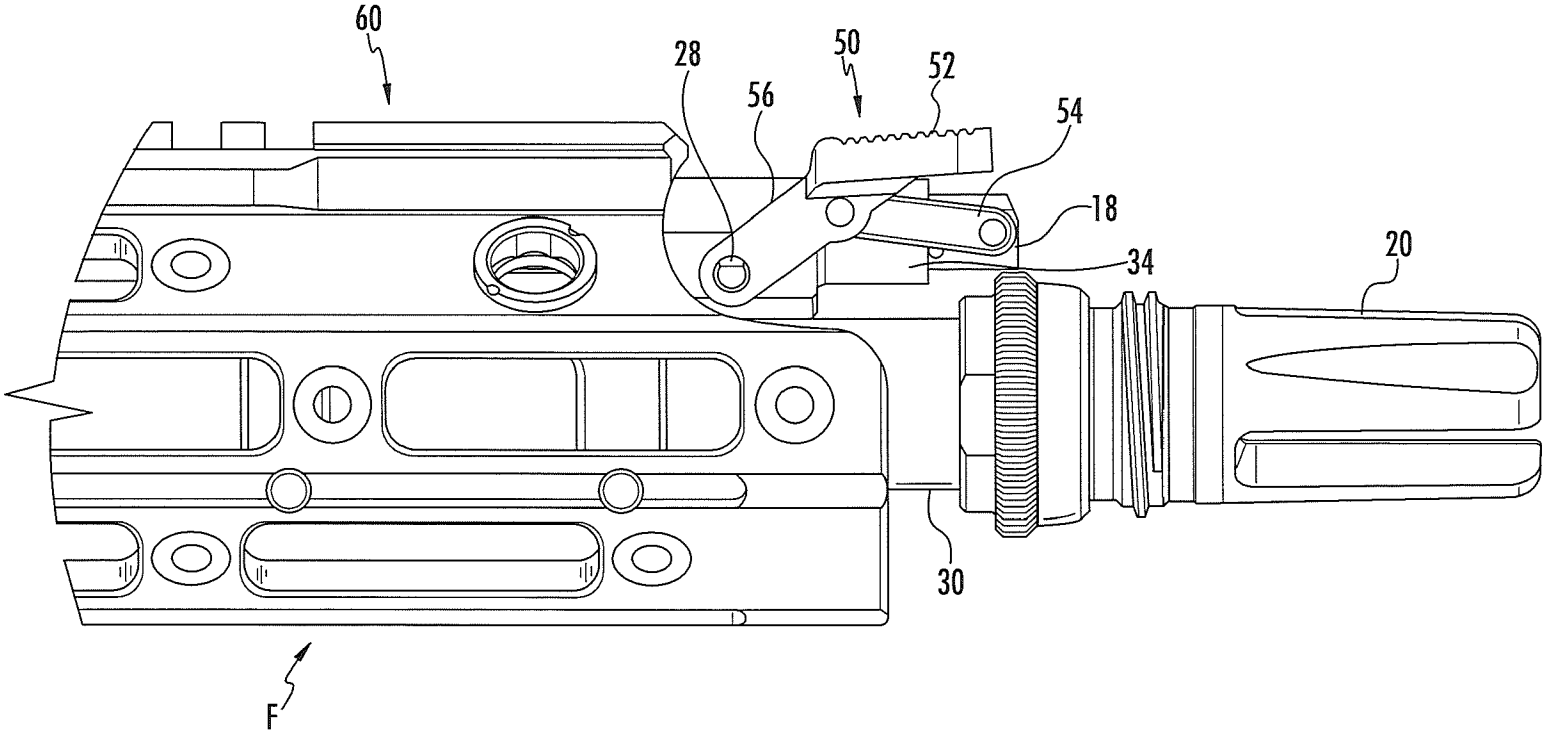
FIG. 1 illustrates a side view of the auto regulating gas system and mechanical linkage assembly when a suppressor is not installed in accordance with an exemplary embodiment.

The following description is provided as an enabling teaching of embodiments of the invention. Those skilled in the relevant art will recognize that many changes can be made to the embodiments described, while still obtaining the beneficial results. It will also be apparent that some of the desired benefits of the embodiments described can be obtained by selecting some of the features of the embodiments without utilizing other features. Accordingly, those who work in the art will recognize that many modifications and adaptations to the embodiments described are possible and may even be desirable in certain circumstances. Thus, the following description is provided as illustrative of the principles of the invention and not in limitation thereof, since the scope of the invention is defined by the claims.

There have been documented cases of weapon failing to operate when users fail to switch the weapons from unsuppressed to suppressed operation or vice versa when installing or removing a suppressor. The disclosed embodiments provide a means to automatically switch the weapon between these two states, thereby assuring proper weapon operation.

In related, co-pending, commonly-owned patent application, Ser. No. 13/799,734 incorporated by reference herein, two separate gas ports in the barrel are utilized and one port is sealed off when a suppressor is installed. In the embodiments described herein, a single port in the barrel can be utilized and the flow of gases from the port can be restricted by an opening in a regulator plunger that aligns with the corresponding ports in the barrel and gas block when a suppressor is installed. A mechanical backup assist system is also provided. In this embodiment, an auto loading weapon is cycled utilizing propulsion gases from the firing of a cartridge. Gases are bled off from the barrel of the weapon and can be diverted to operate either a piston in a piston driven weapon, or to directly operate the bolt and bolt carrier in a direct gas impingement weapon, in either system, the installation of a suppressor or silencer typically increases the operating velocity of the bolt and bolt carrier, which is detrimental to the longevity and functional reliability of the weapon. The disclosed embodiments do not utilize a manually switched gas system to either divert (bleed off) or restrict gases in order to reduce the overall energy available to operate the firearm.

As depicted in FIGS. 1-5, in one exemplary embodiment, the gas-operated mechanism of an auto loading rifle F can be adjusted automatically when a suppressor 40 is attached to the muzzle of the rifle. The operating characteristics of the weapon are changed automatically with the installation of a suppressor 40 or other muzzle device, such as a blank firing adapter. The automatic regulating gas system could be applied to both direct gas impingement operated weapons and piston operated weapons. An embodiment is described below, and in the accompanying drawings, in which the automatic regulating gas system is applied to a direct impingement system. A mechanical backup linkage assembly 50 is also disclosed for the automatic regulating gas system to provide both a visual indication of the firearm's setting (suppressed or unsuppressed) and a manual backup of the regulating system should the automatic regulating gas system fail to switch positions from suppressed to unsuppressed mode in which the plunger is spring-based forward.

FIG. 1 illustrates a side view of the auto regulating gas system and mechanical linkage assembly when a suppressor is not installed. It depicts a firearm F having a barrel 30 with a flash hider 20 installed on the muzzle end. Also shown are gas block 34, accessory rail 60, plunger assembly regulator cap 18, and mechanical linkage assembly 50. The mechanical linkage assembly 50 includes a lever or paddle 52, and links 54, 56. Identical links generally are installed on the opposite side of the firearm with regulator plunger retaining pin 28 also serving as the pivot point for the linkage assembly. FIGS. 1-4 further show a flash hider 20 installed on the muzzle end of barrel 30. Also shown in FIGS. 1-5 is the mounting rail 60 extending over the gas block 34.

Figure 3:
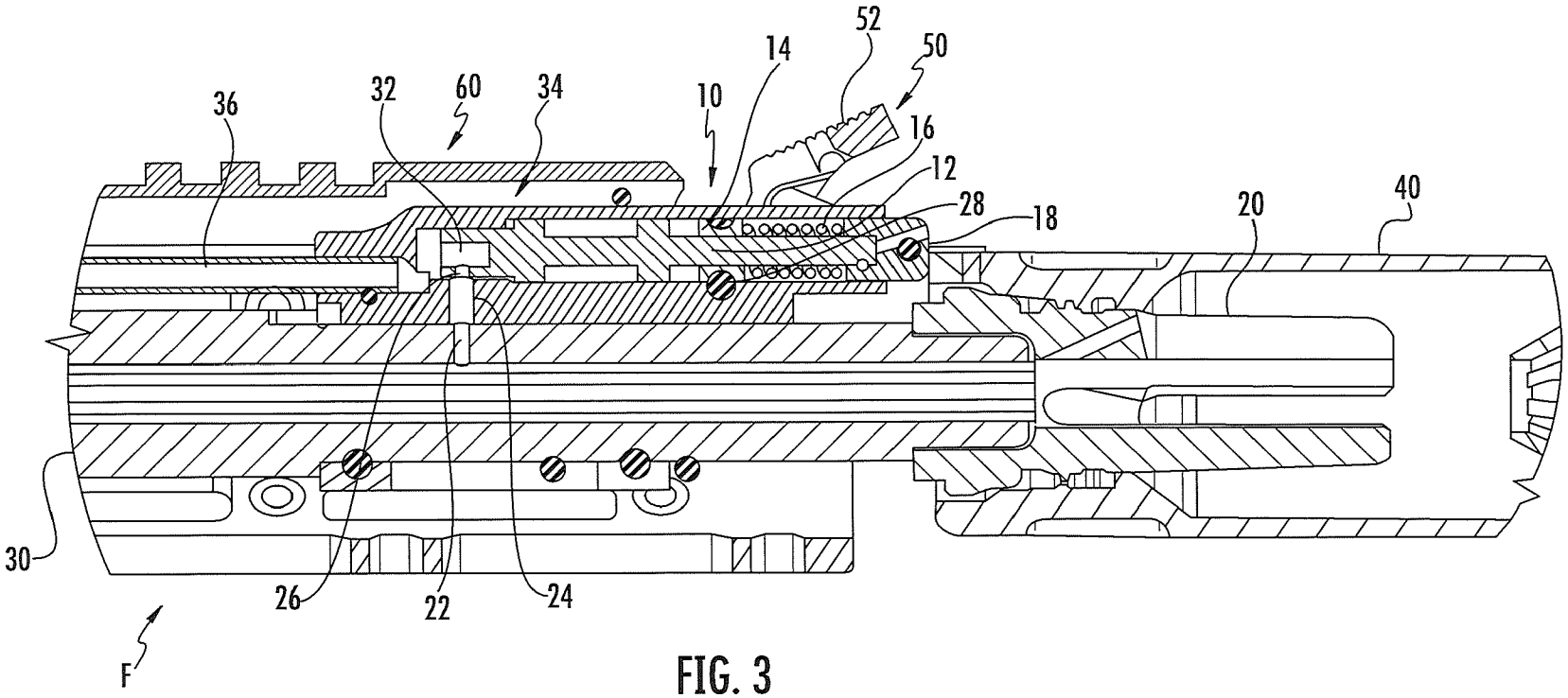
FIG. 3 illustrates a side cross-sectional view of the auto regulating gas system and mechanical backup linkage assembly when a suppressor is installed in accordance with an exemplary embodiment.
Figure 5:
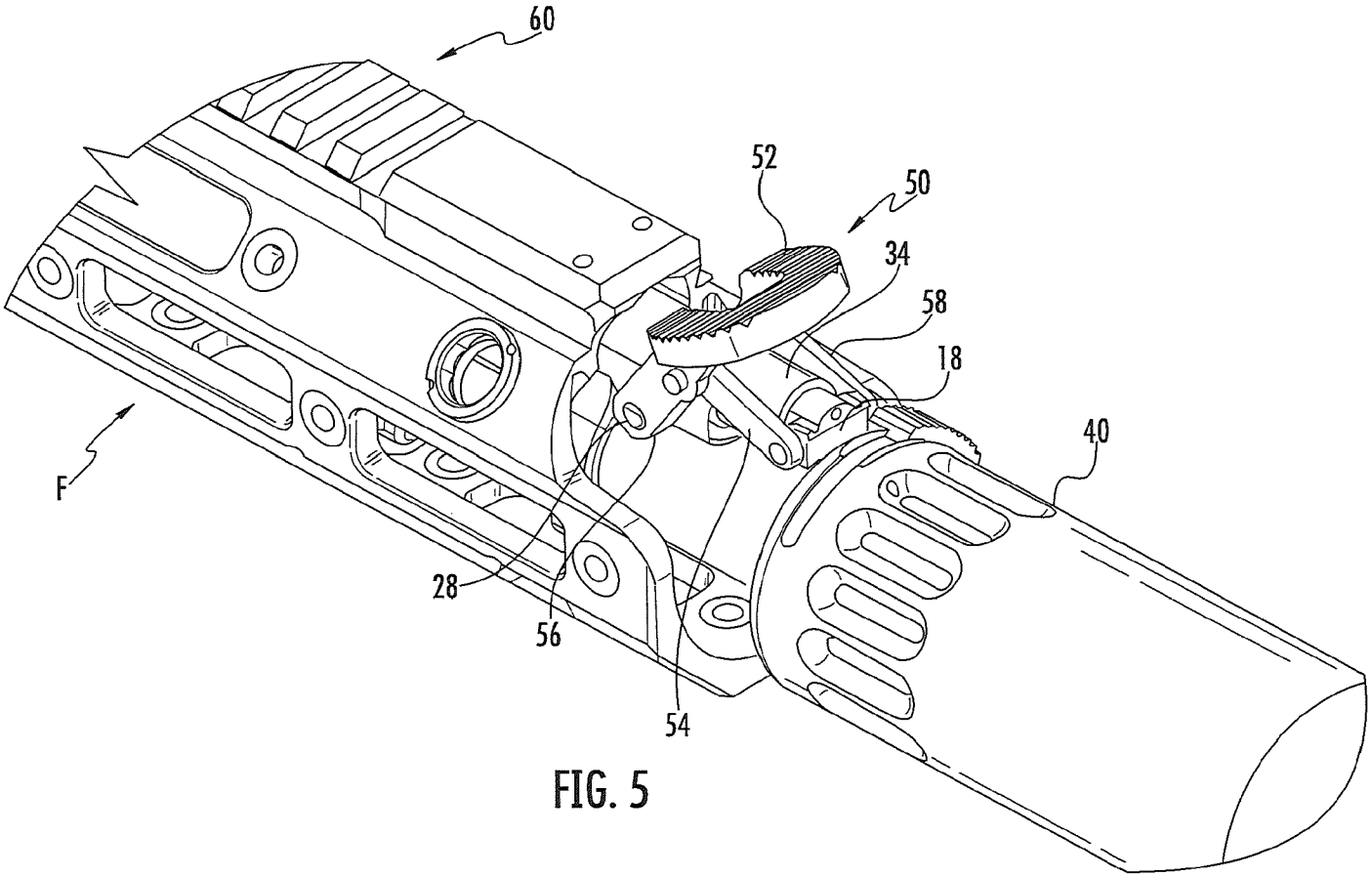
FIG. 5 illustrates an isometric view of the auto regulating gas system and mechanical backup linkage assembly when a suppressor is installed in accordance with an exemplary embodiment.

The barrel 30 for an autoloading rifle may have a suppressor 40 attached to the muzzle end of the weapon. The suppressor 40 can be installed over flash hider 20 as shown in FIGS. 3 and 5. The barrel 30 will include a chamber to accept a cartridge, a bore, one or more gas orifices (ports) 22, and a muzzle.

Figure 2:
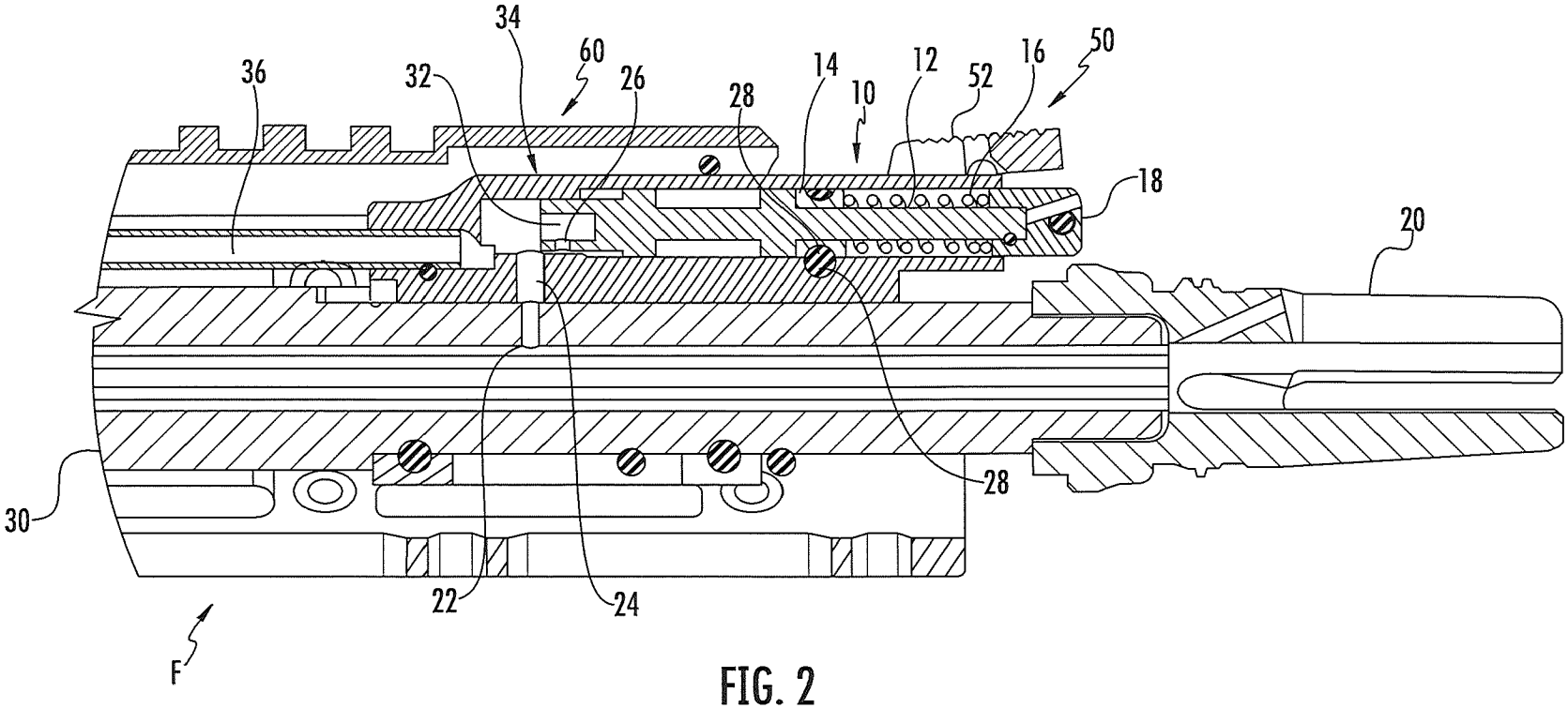
FIG. 2 illustrates a side cross-sectional view of the auto regulating gas system and mechanical backup linkage assembly when a suppressor is not installed in accordance with an exemplary embodiment.

The gas block 34 can be attached to the barrel 30 to redirect the propellant gases to cycle the action of the weapon either through the use of a gas tube 36, shown in FIGS. 2-3, that redirects the gases into the bolt carrier group in a direct impingement rifle, or into a piston system that cycles the weapon with direct mechanical force.

FIGS. 2-3 illustrate side cross-sectional views of the auto regulating gas system without and with a suppressor installed, respectively. In this exemplary embodiment, in a direct impingement weapon, the barrel 30 includes a gas port 22 that redirects propellant gases from the bore of the barrel into a gas passage 24 within the gas block 34. With a suppressor installed (FIG. 3), the suppressor 40 can engage a regulator plunger 12, which at least partially closes or restricts the passage of gases through the gas port 22 such that the gas port 22 and gas passage 24 redirect the propellant gas through a restricted opening 26 in the regulator plunger 12 into the gas tube 36. The propellant gas is then passed down the gas tube 36 into the bolt carrier group (not shown) where the gas acts in a standard method to cycle the action of the weapon.

As illustrated in FIGS. 1-4, the regulator plunger assembly 10 generally can operate co-axially with the bore of the weapon. The regulator plunger assembly 10 is spring-loaded to bias the plunger assembly 10 to the forward position, referred to herein as the "unsuppressed" setting. The regulator plunger assembly 10 operates in a bore of a gas block 34 co-axial to the bore of the weapon. The gas block 34 has a passage or passages 24 that correspond to ports 22 in the barrel 30 that are roughly perpendicular to the bore of the weapon and serve to bleed off propulsion gases for the purpose of cycling the weapon. The gas block 34 diverts these operating gases into either a piston chamber in a piston operated weapon, or into a gas tube 36 via a counter bore 32 in the plunger that provides passage for the operating gases back to the bolt carrier group in a gas impingement weapon.

In one embodiment, the spring loaded plunger assembly 10 can be positioned within a larger bore of the gas block 34 and will be oriented parallel with the bore of the barrel 30 of firearm F. As also show in FIG. 4, a flash hider/flash suppressor 20 could be mounted over the muzzle end of barrel 30. The plunger assembly 10 can include a regulator plunger 12, regulator bushing 14, regulator spring 16, and regulator cap 18. The regulator plunger 12 includes a restricted opening (i.e., reduced flow orifice) that aligns with the barrel port 22 and gas block port 24 when the regulator plunger is moved rearward by mounting of the muzzle device. The plunger assembly 10 may be removed from the gas block 34 as a unit or substantially unitary assembly, and can be retained by a cross pin 28 to prevent forward and rearward motion of the regulator bushing 14, which cross pin 28 also can serve as the primary pivot point for the mechanical linkage assembly 50.

The mechanical backup linkage assembly 50 includes a top lever or paddle 52, with links 54, 56 mounted along the sides of the mechanical backup linkage assembly 50. The mechanical backup linkage assembly 50 provides a mechanical assist or backup to the spring loaded return system of the regulator plunger 12. Should the regulator plunger 12 not return to the unsuppressed, forward biased condition when the suppressor 40 is removed, the linkage assembly 50 provides a mechanical advantage to the operator in forcing the plunger 12 forward.

As shown in FIGS. 2-3, a larger diameter section of the regulator plunger 12 generally operates within the regulator bore of the gas block 34 and interfaces with the rear surface of the regulator bushing 14 when the plunger is held forward by the regulator spring 16. This interface surface prevents the forward flow of propellant gases from exiting the gas block 34. As also indicated in FIGS. 2-3, another smaller diameter section of the regulator plunger 12 extends through the regulator bushing 14 and towards the front end of the gas block 34. The regulator cap 18 slides over the end of the small diameter of the regulator plunger 12 and is retained by a cross pin 28. The regulator cap 18 captures the regulator spring 16 in a slightly compressed state between the forward face of the regulator bushing 14 and the regulator cap 18. The regulator spring 16 operates within the regulator bore on the gas block 34 and surrounds the small diameter of the regulator plunger 12. The regulator cap 18 extends out the front end of the gas block 34 towards the muzzle.

When the weapon fires unsuppressed, the regulator plunger 12 may cycle backward on contra-recoil, wiping the surfaces of the bore/gas passage 24 of the gas block to keep carbon from building up. A seal between the regulator plunger 12 and regulator bushing 14 prevents gas from getting into the regulator spring 16. The regulator plunger 12, in the unsuppressed setting, does not alter the operating characteristics of the weapon. However, when a suppressor 40 or other muzzle device is installed onto the muzzle of the weapon, the regulator plunger 12 is depressed through the action of installing the suppressor 40. The regulator plunger 12 contains reduced flow orifice 26 that is introduced over the gas passage 24 in the gas block to restrict the flow of gases from the gas port 22 on the barrel 30 into the counter bore 32 and gas tube 36. This restricted gas flow is sized so that the operating velocity of a weapon with the suppressor 40 installed roughly matches the operating velocity of an unsuppressed weapon. When the suppressor 40 is removed from the muzzle of the weapon, the spring loaded plunger 12 returns to its forward position, allowing unrestricted gas flow from the barrel 30 to the operating system of the weapon.

In other embodiments, the installation of other muzzle devices, such as grenade launchers and adapters for the use of blank firing ammunition, could also require a restriction in the gas available to operate the weapon to prevent overspeed conditions. These muzzle devices could be designed in such a way to operate the regulator plunger in a manner identical to the suppressor installation, thereby restricting the operating gases and maintaining the proper operating speed of the weapon.

Figure 4:
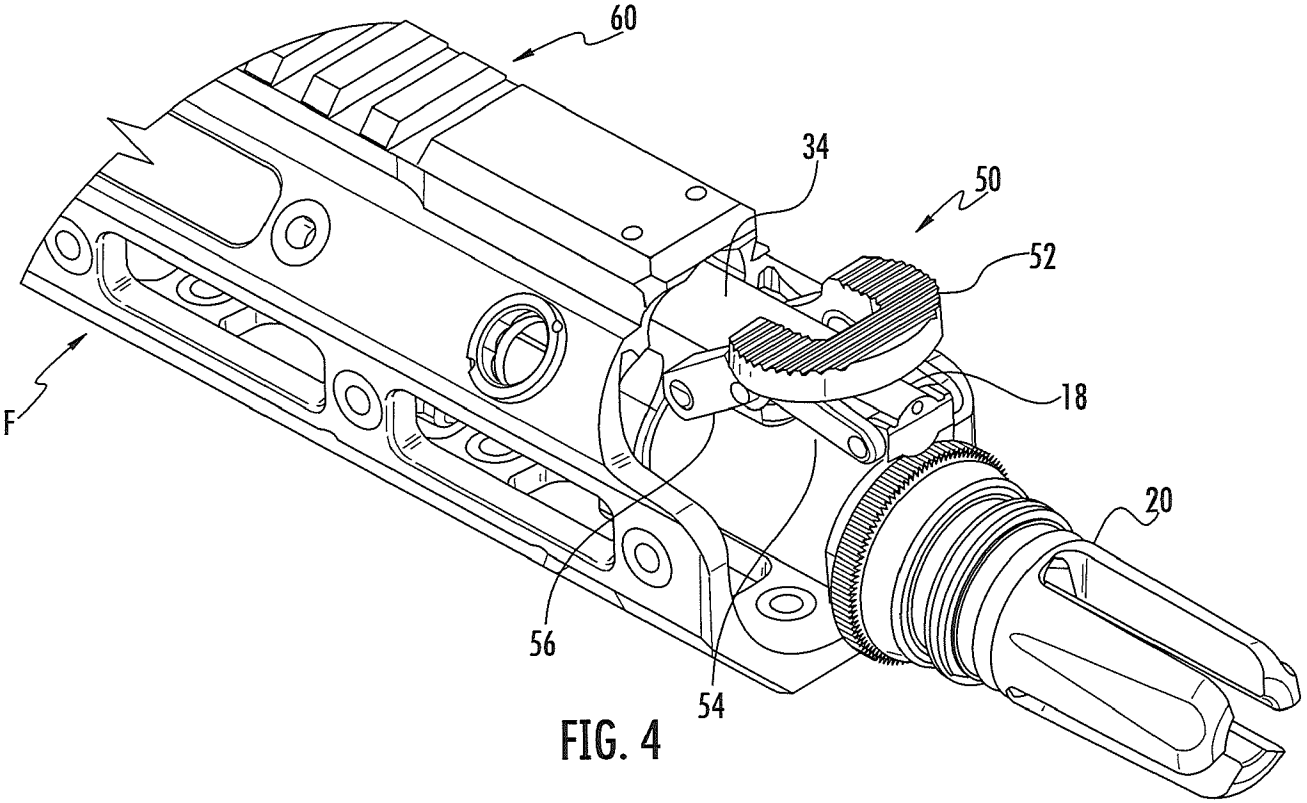
FIG. 4 illustrates an isometric view of the auto regulating gas system and mechanical backup linkage assembly when a suppressor is not installed in accordance with an exemplary embodiment.

In operation, as illustrated in FIG. 4, in the unsuppressed mode, the lever (paddle) 52 is forced forward by the spring-biased return spring (not shown) of the plunger assembly and is attached above the plunger 12 and horizontal to the bore. In the suppressed mode, as illustrated in FIG. 5, the plunger 12 lifts the assist lever 52 as it is depressed by the suppressor 40, thereby providing a highly visible indicator of the plunger position. Pushing down on the paddle 52 provides a strong mechanical advantage forcing the plunger 12 back to the unsuppressed setting. The mechanical advantage afforded by the lever 52 would only be used as a backup to the plunger spring system and in the case of extreme fouling. The entire mechanical backup linkage assembly 50 and plunger assembly 10 can be removed without the use of any tools by pressing a detented cross pin 28 on the left side of the firearm F and lifting the lever 52. The lever 52 then can be used as a grip to pull out the plunger assembly 10. The detented cross pin 28 retains the plunger cartridge and acts as a fixed pivot for the mechanical backup linkage assembly 50.

Figure 6:
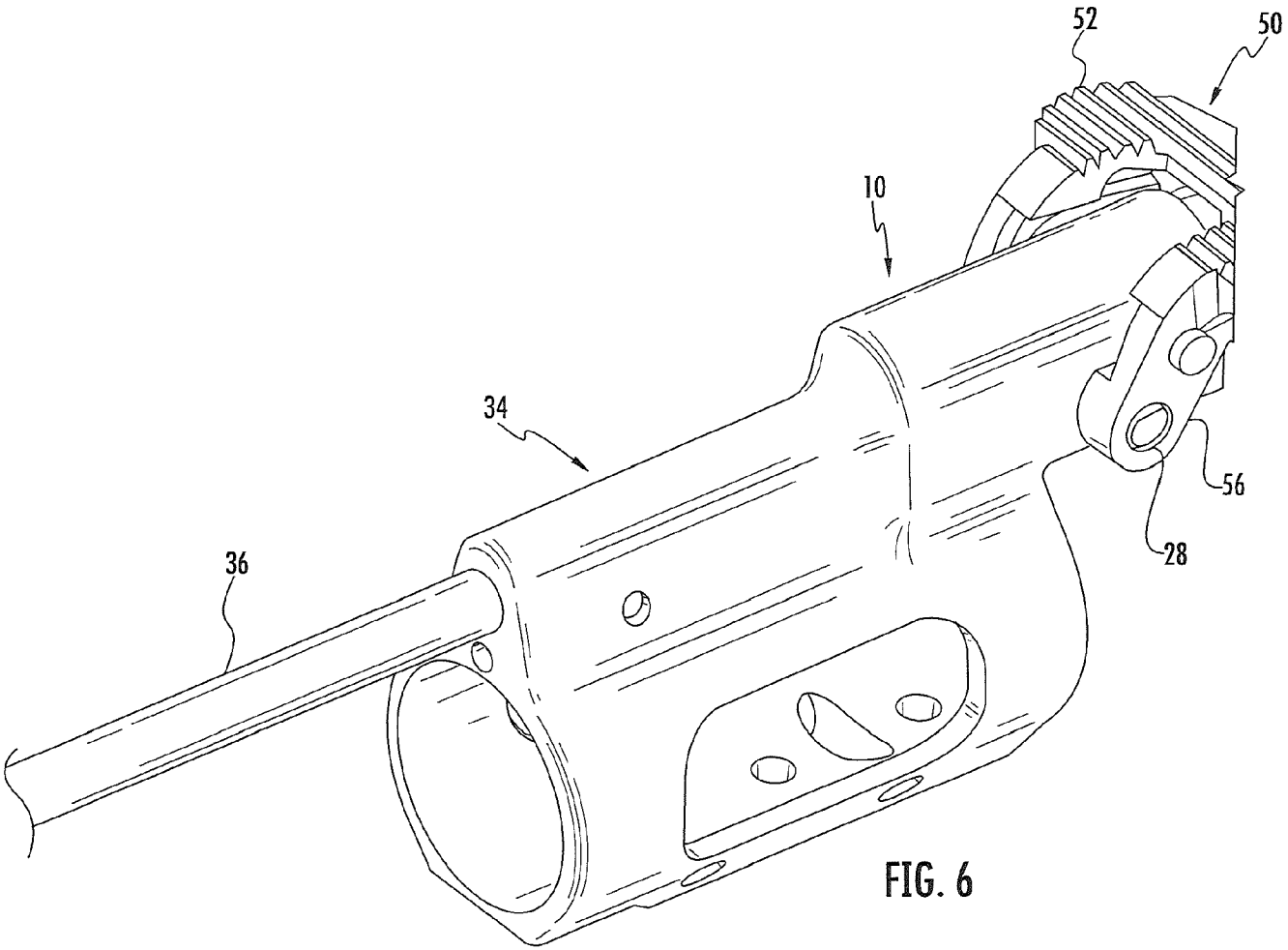
FIG. 6 illustrates an isometric view of the auto regulating gas system and mechanical backup linkage assembly in an unsuppressed mode in another embodiment.
Figure 7:
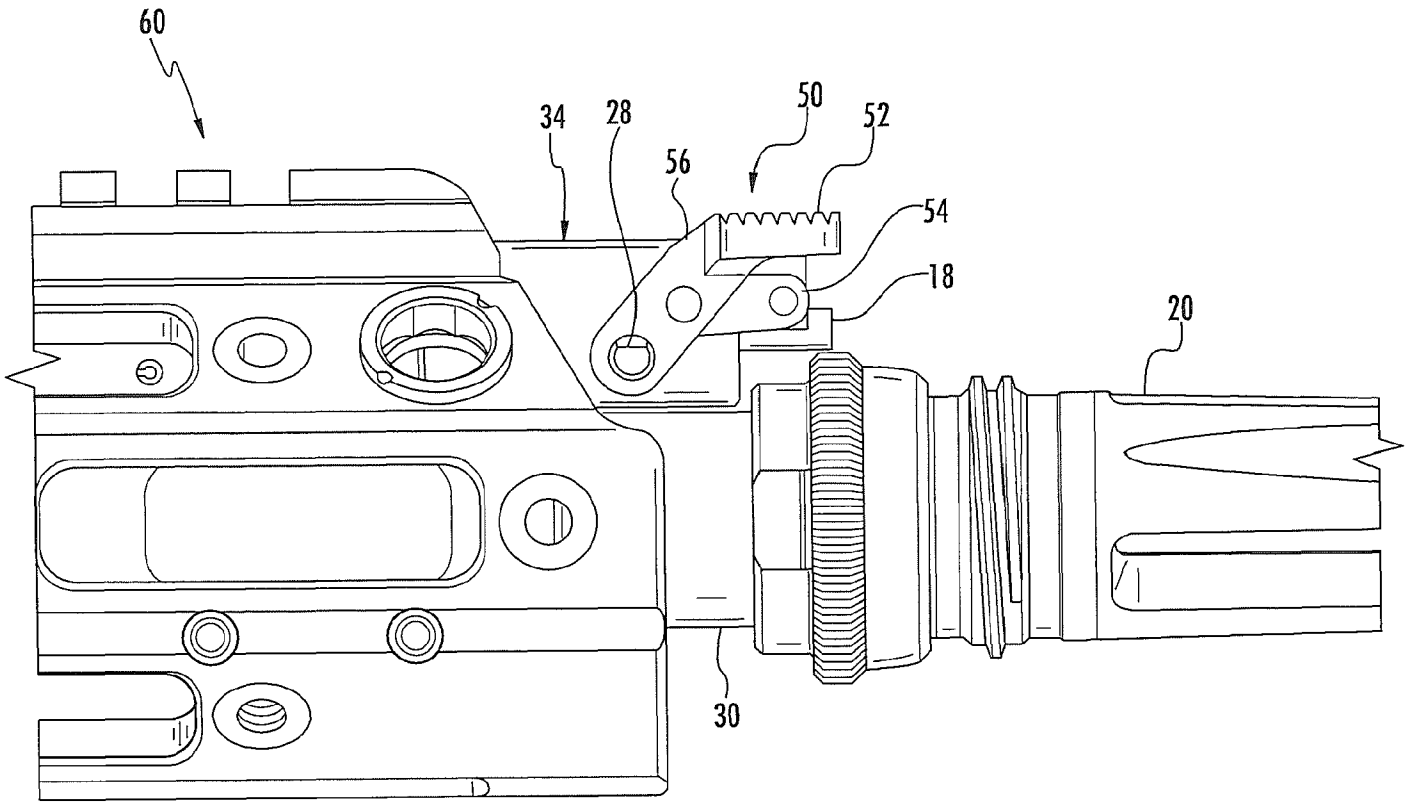
FIG. 7 illustrates a side view of the auto regulating gas system and mechanical backup linkage assembly of FIG. 6 in an unsuppressed mode.
Figure 8:
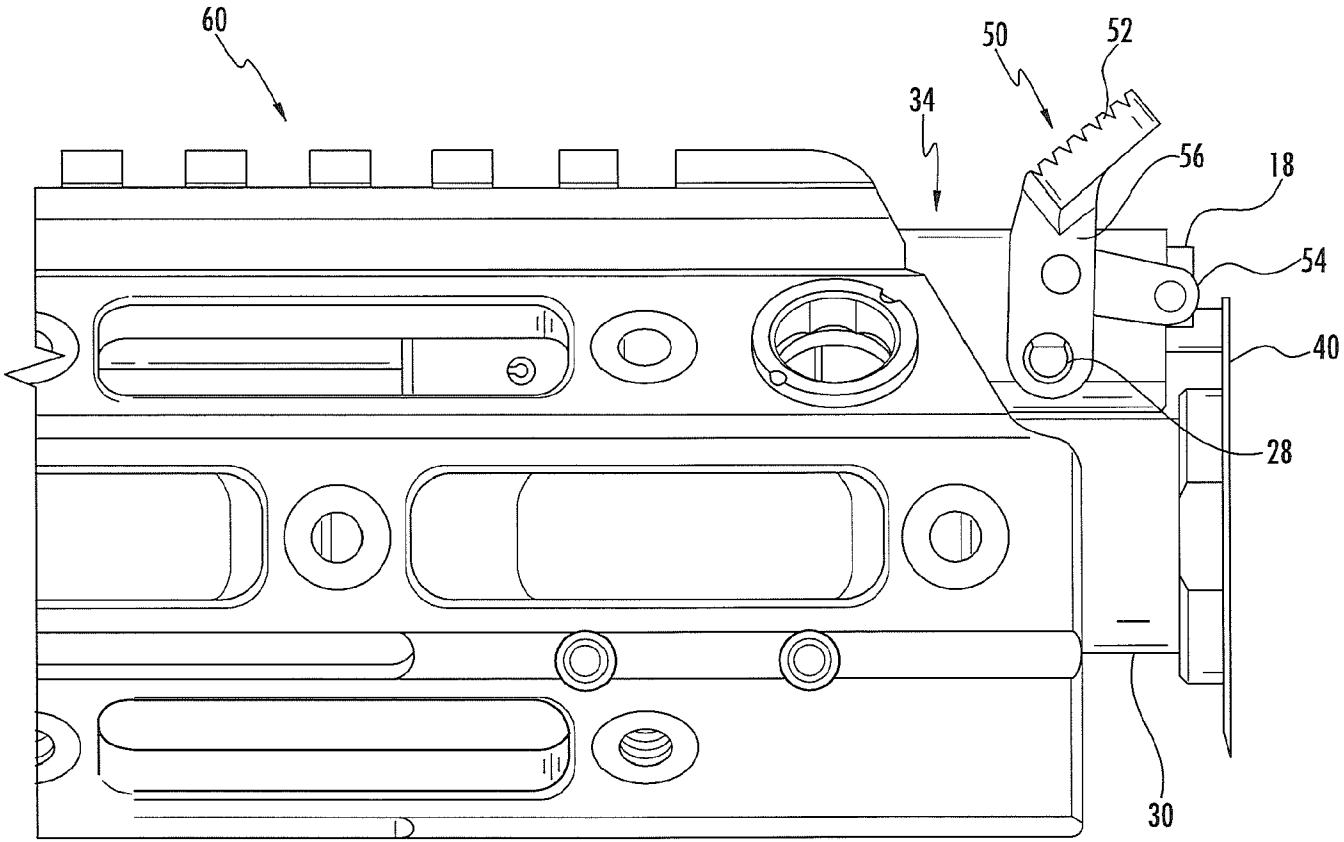
FIG. 8 illustrates a side view of the auto regulating gas system and mechanical backup linkage assembly of FIG. 6 in a suppressed mode.
Figure 9:
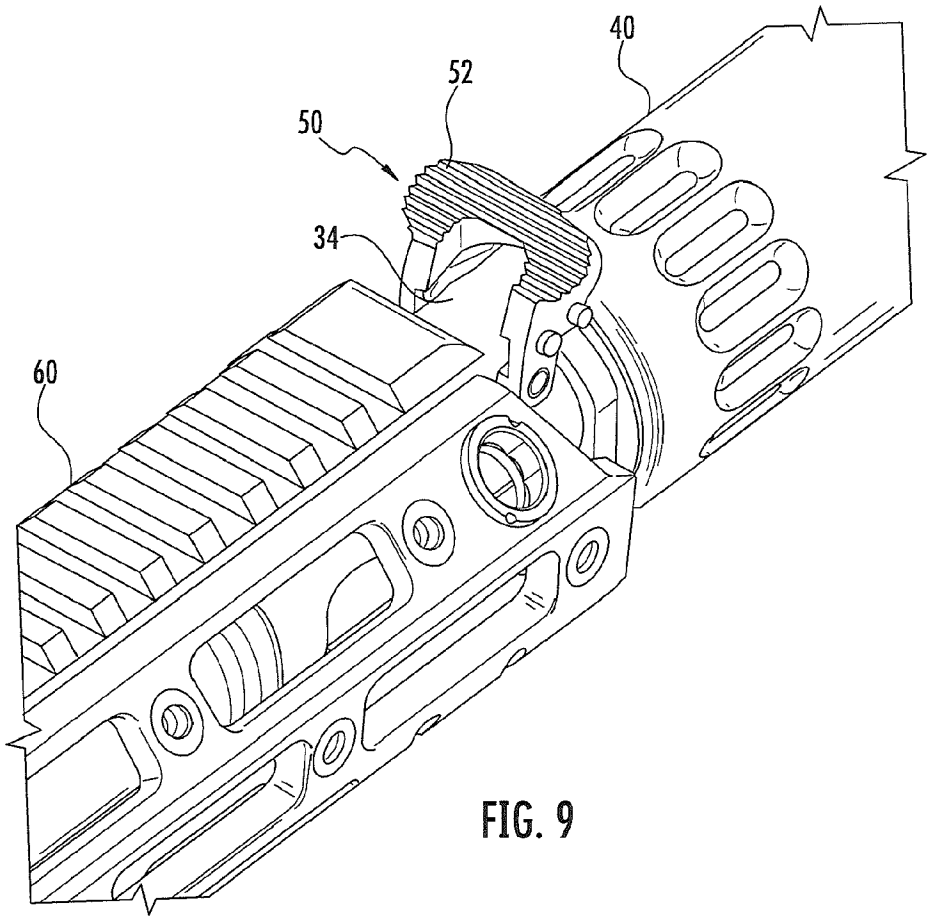
FIG. 9 illustrates an isometric view of the auto regulating gas system and mechanical backup linkage assembly of FIG. 6 in a suppressed mode.

FIGS. 6-9 illustrate another embodiment in which the links of the mechanical backup linkage assembly 50 can be of a reduced or shorter length or size than in the embodiment illustrated in FIGS. 1-5. Operation of both embodiments remains the same. FIG. 6 illustrates an isometric view of the auto regulating gas system and mechanical linkage assembly in an unsuppressed mode. FIG. 7 illustrates a side view of the auto regulating gas system and mechanical linkage assembly of FIG. 6 in an unsuppressed mode. The links 54, 56 in the mechanical linkage assembly 50 generally will be sized such that the lever 52 cannot be adjusted to a vertical position since the lever 52 could then interfere with firearm accessories positioned on handguard/accessory rail 60. FIG. 8 illustrates a side view of the auto regulating gas system and mechanical linkage assembly of FIG. 6 in a suppressed mode. FIG. 9 illustrates an isometric view of the auto regulating gas system and mechanical linkage assembly in a suppressed mode.

The corresponding structures, materials, acts, and equivalents of all means plus function elements in any claims below are intended to include any structure, material, or acts for performing the function in combination with other claim elements as specifically claimed.

Those skilled in the art will appreciate that many modifications to the exemplary embodiments are possible without departing from the scope of the present invention. In addition, it is possible to use some of the features of the embodiments disclosed without the corresponding use of the other features. Accordingly, the foregoing description of the exemplary embodiments is provided for the purpose of illustrating the principles of the invention, and not in limitation thereof, since the scope of the invention is defined solely by the appended claims.

What is claimed:

1. An auto regulating gas system for an auto loading firearm comprising:

a gas block attached to a barrel of the firearm to redirect a volume of propellant gases, the gas block including a gas port for directing propellant gases received from a gas port of the barrel into the gas system to cycle the auto loading firearm; and a spring-loaded plunger assembly positioned within the gas block, the plunger assembly including a regulator plunger having a reduced flow orifice, a regulator bushing, a regulator spring, and a regulator cap, wherein the position of the regulator plunger within the gas block automatically controls an amount of gas that is allowed to enter the gas system;

wherein mounting a muzzle device over the muzzle drives the regulator plunger rearward moving the reduced flow orifice over the gas port in the gas block to automatically reduce the volume of propellant gases directed into the gas system.

2. The auto regulating gas system for an auto loading firearm of claim 1 wherein the muzzle device comprises a suppressor.

3. The auto regulating gas system for an auto loading firearm of claim 1 wherein the muzzle device comprises a blank adapter or a grenade launcher.

4. The auto regulating gas system for an auto loading firearm of claim 1 further comprising a mechanical assist device attached to the gas block near a forward end, the mechanical assist device being manually actuated to return the regulator plunger to an unsuppressed forward-biased position when the muzzle device is removed.

5. The auto regulating gas system for an auto loading firearm of claim 4 wherein the mechanical assist device comprises a top lever and a linkage assembly.

6. The auto regulating gas system for an auto loading firearm of claim 5 wherein the linkage assembly comprises a plurality of links with a pair of links connected to each other on each side of the gas block, a first link of each pair being attached to a cross pin about which the linkage assembly can pivot, and a second link of each pair being connected to the regulator cap.

7. The auto regulating gas system for an auto loading firearm of claim 5 wherein the rearward movement of the regulator plunger by the muzzle device automatically raises the top lever above a horizontal orientation relative to the gas block.

8. The auto regulating gas system for an auto loading firearm of claim 6 wherein the plurality of links are sized such that the top lever cannot be adjusted to a vertical position relative to the gas block in order to avoid interference with firearm accessories mounted on an accessory rail of the firearm.

9. The auto regulating gas system for an auto loading firearm of claim 1 wherein the regulator plunger operates within a bore of the gas block co-axial to a bore of the firearm.

10. The auto regulating gas system for an auto loading firearm of claim 9 wherein the regulator plunger interfaces with a rear surface of the regulator bushing to prevent a forward flow of propellant gases from exiting the gas block.

11. The auto regulating gas system for an auto loading firearm of claim 1 wherein the regulator cap is slideably mounted over an end of the regulator plunger and is retained by a cross pin.

12. The auto regulating gas system for an auto loading firearm of claim 1 wherein the regulator cap compresses the regulator spring between a forward face of the regulator bushing and the regulator cap.

13. The auto regulating gas system for an auto loading firearm of claim 1 wherein the regulator spring operates within a regulator bore of the gas block and is mounted over a portion of the regulator plunger.

14. The auto regulating gas system for an auto loading firearm of claim 1 wherein a portion of the regulator cap extends past the front end of the gas block towards the muzzle and is driven rearward when the muzzle device is mounted over the muzzle, the rearward movement of the regulator cap driving the regulator plunger rearward to reduce the flow of propellant gases into the gas tube.

15. The auto regulating gas system for an auto loading firearm of claim 6 wherein the cross pin retains the plunger assembly in position in a bore of the gas block to prevent movement of the regulator bushing.

16. The auto regulating gas system for an auto loading firearm of claim 1 wherein the regulator spring returns the regulator plunger to a forward position when the muzzle device is removed from the firearm.

17. The auto regulating gas system for an auto loading firearm of claim 1 wherein the reduced flow orifice is sized such that an operating velocity of the firearm with the muzzle device installed approximates the operating velocity of the firearm in an unsuppressed condition.

18. A auto regulating gas system for an auto loading firearm comprising:

a gas block attached to the barrel to redirect a volume of propellant gases to cycle the auto loading weapon, the gas block including a gas port for directing propellant gases received from a gas port of the barrel into the gas system;

a spring-loaded plunger assembly positioned within the gas block, the plunger assembly including a regulator plunger having a reduced flow orifice, a regulator bushing, a regulator spring, and a regulator cap, wherein the position of the regulator plunger within the gas block automatically controls an amount of gas that is allowed to enter the gas system; and a mechanical backup linkage assembly attached to the gas block for returning the regulator plunger to a forward position in the gas block when a muzzle device mounted on a muzzle of the firearm is removed.

19. The auto regulating gas system for an auto loading firearm of claim 18 wherein the mechanical backup linkage assembly comprises an upper lever and a plurality of links with a pair of links connected to each other on each side of the gas block, a first link of each pair being attached to a cross pin about which the linkage assembly can pivot, and a second link of each pair being connected to the regulator cap.

20. The auto regulating gas system for an auto loading firearm of claim 18 wherein the mechanical backup linkage assembly is manually actuated to return the regulator plunger to an unsuppressed forward-biased position when the muzzle device is removed.

21. The auto regulating gas system for an auto loading firearm of claim 18 wherein a rearward movement of the regulator plunger by the muzzle device automatically raises an assist lever of the mechanical backup linkage assembly above a horizontal orientation relative to the gas block.

22. The auto regulating gas system for an auto loading firearm of claim 21 wherein the mechanical backup linkage assembly comprises a plurality of links sized such that the upper lever cannot be adjusted to a vertical position relative to the gas block in order to avoid interference with firearm accessories mounted on an accessory rail of the firearm.

23. The auto regulating gas system for an auto loading firearm of claim 18 wherein the regulator spring returns the regulator plunger to a forward position when the muzzle device is removed from the firearm.

24. The auto regulating gas system for an auto loading firearm of claim 18 wherein the reduced flow orifice is sized such that an operating velocity of the firearm with the muzzle device installed approximates the operating velocity of the firearm in an unsuppressed condition.

25. A method for auto regulation of propellant gases in an autoloading firearm comprising:

attaching a gas block to a barrel of the firearm to redirect a volume of propellant gases to cycle the auto loading firearm, the gas block including a gas port for directing propellant gases received from a gas port of the barrel into the gas system;

positioning a spring-loaded plunger assembly within the gas block, the plunger assembly including a regulator plunger having a reduced flow orifice, a regulator bushing, a regulator spring, and a regulator cap wherein the position of the regulator plunger within the gas block automatically controls an amount of gas that is allowed to enter the gas system;

attaching a mechanical backup linkage assembly to the gas block for returning the regulator plunger to a forward position in the gas block when a muzzle device mounted on a muzzle of the firearm is removed.

26. The method for auto regulation of propellant gases in an autoloading firearm of claim 25 further comprising sliding the regulator cap over an open end of the regulator plunger and retaining the regulator cap with a cross pin.

27. The method for auto regulation of propellant gases in an autoloading firearm of claim 26 wherein sliding the regulator cap over the open end of the regulator plunger compresses the regulator spring mounted over the regulator plunger between a forward face of the regulator bushing and the regulator cap.

28. The method for auto regulation of propellant gases in an autoloading firearm of claim 25 wherein mounting the muzzle device over the muzzle drives a portion of the regulator cap extending past the front end of the gas block rearward when the muzzle device contacts the regulator cap, the rearward movement of the regulator cap driving the regulator plunger rearward to reduce the flow of propellant gases into the gas system.

29. The method for auto regulation of propellant gases in an autoloading firearm of claim 25 wherein actuation of the mechanical backup linkage assembly lifts a lever of the assembly from a horizontal position to a raised position to provide a manual mechanism for returning the regulator plunger to a forward position in the gas block if the regulator spring fails to do so when the muzzle device is removed.

* * * * *